US006561502B1

(12) United States Patent
Flickner

(10) Patent No.: US 6,561,502 B1
(45) Date of Patent: May 13, 2003

(54) DOUBLE-LAYERED WIDTH-ADJUSTABLE INSERTER TRACKS

(75) Inventor: Brett Jay Flickner, Folsom, CA (US)

(73) Assignee: DST Output of California, Inc., El Dorado Hills, CA (US)

( * ) Notice: Subject to any disclaimer, the term of this patent is extended or adjusted under 35 U.S.C. 154(b) by 0 days.

(21) Appl. No.: 10/071,591

(22) Filed: Feb. 7, 2002

(51) Int. Cl.[7] ..... R65H 39/05

(52) U.S. Cl. ..... 270/58.06; 270/58.27; 271/240; 271/253

(58) Field of Search ..... 270/58.06, 58.08, 270/58.27; 53/284.3, 540; 198/735.3, 418.3; 271/240, 248, 253, 9.02, 9.13, 264

(56) References Cited

U.S. PATENT DOCUMENTS

| | | | | | |
|---|---|---|---|---|---|
| 2,384,506 | A | * | 9/1945 | Thompson | 53/460 |
| 3,692,223 | A | * | 9/1972 | Laigle et al. | 242/615.3 |
| 3,965,644 | A | | 6/1976 | Stocker | |
| 4,169,341 | A | * | 10/1979 | Roetter et al. | 53/154 |
| 4,494,742 | A | * | 1/1985 | Guenther et al. | 270/58.29 |
| 4,753,429 | A | * | 6/1988 | Irvine et al. | 270/58.06 |
| 4,801,036 | A | * | 1/1989 | Rathert | 270/58.29 |
| 4,865,304 | A | | 9/1989 | VanderSyde et al. | |
| 4,943,044 | A | * | 7/1990 | Roscart | 271/248 |
| 5,000,434 | A | | 3/1991 | VanderSyde et al. | |
| 5,106,069 | A | * | 4/1992 | Wolf et al. | 270/58.05 |
| 5,209,467 | A | * | 5/1993 | Schmaling | 271/240 |
| 5,273,265 | A | * | 12/1993 | Edwards | 270/59 |
| 5,327,701 | A | | 7/1994 | Dronsfield | |
| 5,406,771 | A | | 4/1995 | Dronsfield | |
| 5,447,015 | A | * | 9/1995 | Belec et al. | 53/492 |
| 5,487,254 | A | | 1/1996 | Dronsfield | |
| 5,732,939 | A | | 3/1998 | Meier | |
| 5,772,194 | A | | 6/1998 | Huebler et al. | |
| 5,954,323 | A | * | 9/1999 | Emigh et al. | 270/58.06 |

FOREIGN PATENT DOCUMENTS

| | | | | |
|---|---|---|---|---|
| DE | 3628179 | A1 * | 2/1988 | B65G/19/28 |

* cited by examiner

*Primary Examiner*—Donald P. Walsh
*Assistant Examiner*—Matthew J Kuhner
(74) *Attorney, Agent, or Firm*—James M. Ritchey

(57) ABSTRACT

A document transporter apparatus for use on an envelope inserter comprises a first track, for moving a first type of document, mounted to the envelope inserter, a second track, for moving a second type of document, mounted above the first track, and a mechanism for independently adjusting the width of each of the tracks to accommodate various document sizes.

15 Claims, 4 Drawing Sheets

DOUBLE-LAYERED WIDTH-ADJUSTABLE INSERTER TRACKS

BACKGROUND OF THE INVENTION

1. Field of the Invention

Double-layered inserter tracks for an envelope inserter apparatus are provided that may be independently adjusted for width. To accommodate structural features of various types of documents that are to be placed in an envelope by the inserter apparatus, means are disclosed for transporting documents in a double-layered manner in which the width of each track is independently adjustable to a desired dimension, thereby permitting one sized document to be transported within the lower track and a different or same sized document to be transported within the upper track.

2. Description of the Background Art

A machine utilized in filling envelopes with desired items is termed an "inserter." More specifically, an inserter places, inserts, or stuffs statements, inserts, and return envelopes into a send envelope. A statement is a document that is unique to each customer of a particular business such as a general billing service, utility company, cable company, and the like and is delivered to an inserter's inserter track upstream of insert hoppers by appropriate paper handling equipment. Inserts are materials that are loaded into the inserter hopper to be pulled by a picking arm and are typically advertisements, regulatory notices, a return envelope, and similar items. In "stuffing" an envelope the items delivered to the envelope frequently travel within paired transporter tracks. Existing inserter transporter track systems are very limited in accepting and transporting items of various widths.

Many of the envelope inserters utilized by mailing facilities (bulk mailers and the like) for filling envelopes containing a statement (billing document and the like) and one or more inserts (notices, advertisements, and the like) are integrated into a system where sheets are collated, folded, and delivered into an inserter track (as opposed to another common type of inserter which pulls statements and inserts out of a suitable hoppers and individually "stuffs" the envelope with each item as it moves from hopper to hopper). For the first type of inserter, the statements of an inserting job can vary in folded size (commonly from 3½"×6⅝" up to 5½"×8½") and in fold type (C-fold, Z-fold, ½-fold, and the like). Additionally, within any particular mailing job, the statements can vary in number of sheets (usually from one to 16 sheets or more). These variations in the statement can produce transport problems and directly influence the productivity of the inserter. One problem encountered is that the statement has a tendency to open up while being conveyed down the inserter track. With a conventional inserter, these statements will interfere with the inserter picking arms, which swing over the top to the track. If the arm contacts the statement a jam will occur and result in a damaged statement. Also, a statement which is opening up can cause problems with conveying the inserts since any selected inserts rest on top of the statement. If an insert is not controlled properly a jam will occur and result in damaged inserts and lost time. Another problem encountered with standard inserters is caused by the fact that insert sizes are often narrower in width than the statement. With a conventional inserter where all material to be inserted into an envelope is conveyed in the same track, it is required that the track be adjusted to accommodate the widest insert. Of course, this means that the narrow inserts are under less than desired control for optimum performance of the inserter. The subject invention overcomes the limitations of the prior track systems since it contains or holds the statements and prevents them from opening up during transport, allows inserts and statements to be guided by independent tracks, adjusts for the varying widths of folded statements, and adjusts for the varying width of inserts independent of the statement width.

Disclosed in U.S. Pat. No. 3, 965,644 illustrates a typical apparatus and method for mail preparation. Multiple insert stations supply paper documents that are assembled into a packet along an insert raceway. The assembled packet is then "stuffed" into a receiving envelope. A pocket bearing insert sheet is included in the insert documents.

U.S. Pat. Nos. 4,865,304 and 5,000,434 describe an insertion machine with an improved insert track. The description of typical inserter features and problems, found in '304, column 1, line 1, through column 2, line 40, illustrates the initial rationale for the need of improved inserter components, such as inserter tracks. The width of an insert channel is adjustable by loosening a plurality of tension fasteners, positioned along the length of the insert channel, and sliding open or together the front and back fences (first and second edge guides). Each fastener holds both the front and back fences.

An apparatus for inserting material into envelopes is presented in U.S. Pat. No. 5,327,701. The apparatus utilizes first and second conveyor belts to transport insert materials and envelopes, respectively. Non-adjustable grooved members help direct the inserts in a desired path. Envelopes of different lengths are handled by means of adjusting clamps associated with the conveyor drive chain.

As with related patent '701, immediately above, U.S. Pat. No. 5,406,771 shows an apparatus for inserting material into envelopes. Included is a radiation type detector for detecting buckling of the envelope or insert material during the insertion process.

As with related patents '701 and '771, immediately above, U.S. Pat. No. 5,487,254 also provides an apparatus for inserting material into envelopes. A distortion means is provided that partially opens the envelope for inserting material into the envelope.

U.S. Pat. No. 5,732,939 discloses a process for the continuous production of different types of printed products from different types of product parts. A compilation station assembles the printed product.

A sheet material inserter that has a controllable optical feed for sheet material and envelopes, via multiple station feeders, is found in U.S. Pat. No. 5,772,194. Short, guide elements interact with hold-down assemblies to guide the filling material in the direction desired.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teaches or renders obvious, singly or when considered in combination, applicant's claimed invention.

SUMMARY OF THE INVENTION

An object of the present invention is to provide a double-layered and width-adjustable transporter track system for moving documents towards a receiving envelope.

Another object of the present invention is to furnish a dual-layered track system for transporting documents comprising independently width-adjustable tracks displaced vertically from one another.

A further object of the present invention is to supply a document transporter device comprising a plurality of vertically displaced tracks in which each track is adjustable to a desired width.

Still another object of the present invention is to disclose means for transporting at least two streams of documents in which both a lower track and an upper track are independently width-adjustable.

Yet a further object of the present invention is to describe an apparatus for transporting two streams of documents in which both a lower track and an upper track are independently width-adjustable, wherein the lower track comprises variable-position front and rear rails and the upper track comprises a fixed-position front rail and a variable-position rear rail.

Yet an additional object of the present invention is to disclose an apparatus for transporting two streams of documents in which both a lower track and an upper track are independently width-adjustable, wherein the lower track comprises variable-position front and rear rails having top and bottom arms with retaining a gib positioned immediately above each bottom arm and the upper track comprises a fixed-position front rail and a variable-position rear rail.

Disclosed is a document transporter apparatus for use on an envelope inserter having an upper support surface. The subject apparatus comprises a first track, for moving a first type of document, mounted to the upper support surface. The first track further comprises a variable-position front rail having lower and upper legs and a variable-position rear rail having lower and upper legs with each document traveling within the lower and upper legs. The first track further comprises a gib strip secured immediately above each of the front and rear lower legs.

Additionally, included is a second track, for moving a second type of document, mounted above the first track. The second track comprises a fixed-position front rail and a variable-position rear rail with each second type of document traveling over these rails. Further included are a plurality of spacers positioned between the first and the second tracks.

The variable-position capability for each track is provided by width adjustment means on each of the first and the second tracks. A desired width between the front and rear rails for each of the first and the second tracks is selected independently. Usually, the width adjustment means comprises an elongated securing member extending through the first and second tracks and the spacers and mated into receiving apertures in the upper support surface. Preferably, the width adjustment means comprises a knob-headed screw extending through the first and second tracks and the spacers and mated within a threaded aperture in the upper support surface.

Other objects, advantages, and novel features of the present invention will become apparent from the detailed description that follows, when considered in conjunction with the associated drawings.

DESCRIPTION OF THE PREFERRED EMBODIMENT

Referring now to FIGS. 1–5, there is shown a preferred embodiment of a document transporting device having vertically-layered sets of inserter tracks for use with an envelope inserter apparatus. Each set of tracks may be independently adjusted for width.

Generally, the subject apparatus is utilized in connection with an envelope assembly system that assembles mailing pieces for bulk mailing operations. An assembled mailing piece generally comprises an outer mailing envelope and inserted "document packets" comprising forms, that are generally folded (such as detailed and summary billing statements), inserts (such as advertisements, notices, and the like), a return envelope, and similar items. Usually, the envelope or mailing piece assembly system comprises a pre-inserter set of devices such as a forms or pages source, often a printer, form "burster" (separates perforated forms), or the like, means for collating and folding the forms or pages, means of moving the collated and folded forms or pages to an envelope inserter machine 1. The standard envelope inserter machine I comprises means for transporting the documents (collated and folded forms or pages and selected inserts (stored in suitable hoppers H and delivered via picker arms P)) into the mailing envelope (stored in a suitable bin E). Frequently, a belt/chain B or equivalent means, with document engaging means (such as tab projections or pusher arms A), moves each set of documents through the inserter. Means for post or subsequent processing of the stuffed envelopes is usually positioned after the inserter I.

The subject invention 5 is an improved means for transporting the documents (collated and folded forms or pages and selected inserts) through the inserter and comprises a novel path mechanism with an entrance region 6 and an exit region 7. Comprising the subject invention are a plurality of vertically disposed tracks mounted to the support surface of the inserter I. Collated and folded forms or pages that are to be inserted into mailing envelopes enter the tracks via the entrance region 6 and, along with selected inserts, exit via the exit region 7.

Figure 5:
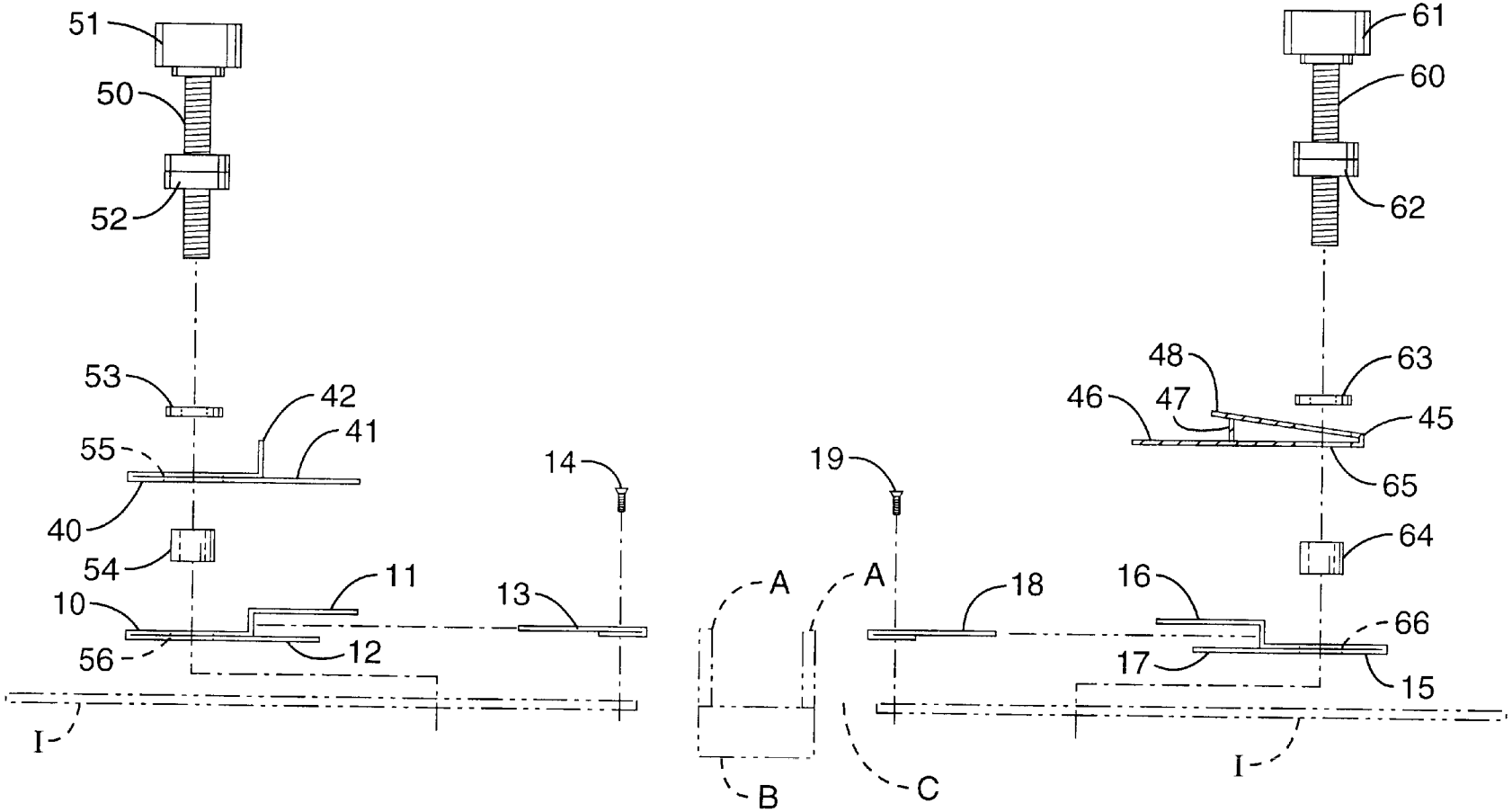
FIG. 5 is an exploded cross-sectional view of the subject invention.

FIG. 5 clearly shows the subject tracts 5. A lower track is comprised of a front rail 10 and a rear rail 15. Documents enter the lower track at flared entrance region 6 comprising widened front rail and rear rail areas 20 and 25, which in turn taper down in transition regions 30 and 35, respectively. Front rail 10 and rear rail 15 run along the top surface of the inserter I and channel, in association with the document engaging belt B, the incoming collated and folded forms or pages through the inserter I.

More specifically, both the lower front rail 10 and lower rear rail 15 include upper legs 11 and 16, respectively, and lower legs 12 and 17, respectively. Usually, the upper legs 11 and 16 project past the lower legs 12 and 17. To prevent the edges of the forms or pages from getting caught beneath the lower legs 12 and 17, protecting gibs 13 and 18 are provided to cover the lower legs 12 and 17, respectively. Gibs 13 and 18 are secured to the inserter I upper surface by suitable means such as screws 14 and 19, respectively, threaded into the inserter I upper surface.

An upper track is comprised of a front rail 40 and a rear rail 45. As a particular form (one set of collated and folded forms or pages have one or more actual sheets) travels through the lower track (moved by a document engaging means B (belt, chain, or like suitable structure), having document pusher arms A, and moving within a channel C), picker arms P pull and drop selected inserts from appropriate hoppers H (this selection process is directed by a suitable associated computer control system) onto the upper track to produce the document packet that will be inserted into the mailing envelope.

The upper track front rail 40 is comprised of a bottom leg 41 and a rear wall 42 and runs atop the lower track front rail 10. Unlike the lower track front rail 10, the upper track front rail 40 has no upper leg 11 (this permits the selected inserts to fall into the upper track). The upper track rear rail 45 is comprised of a bottom leg 46, a rear wall 47, and a short upper leg 48 and runs atop the lower track rear rail 15.

Figure 1:
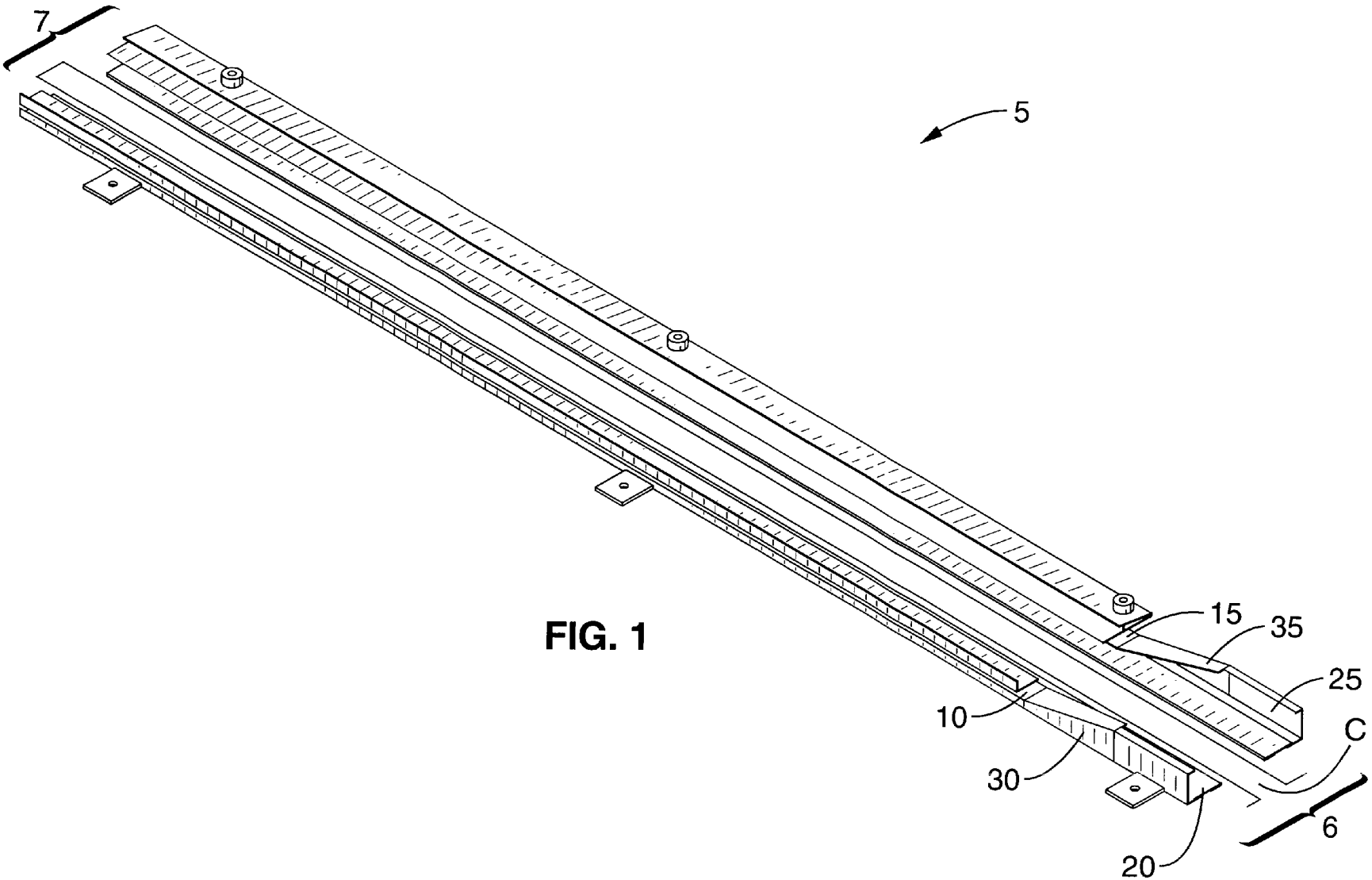
FIG. 1 is a perspective view of the subject invention.
Figure 2:
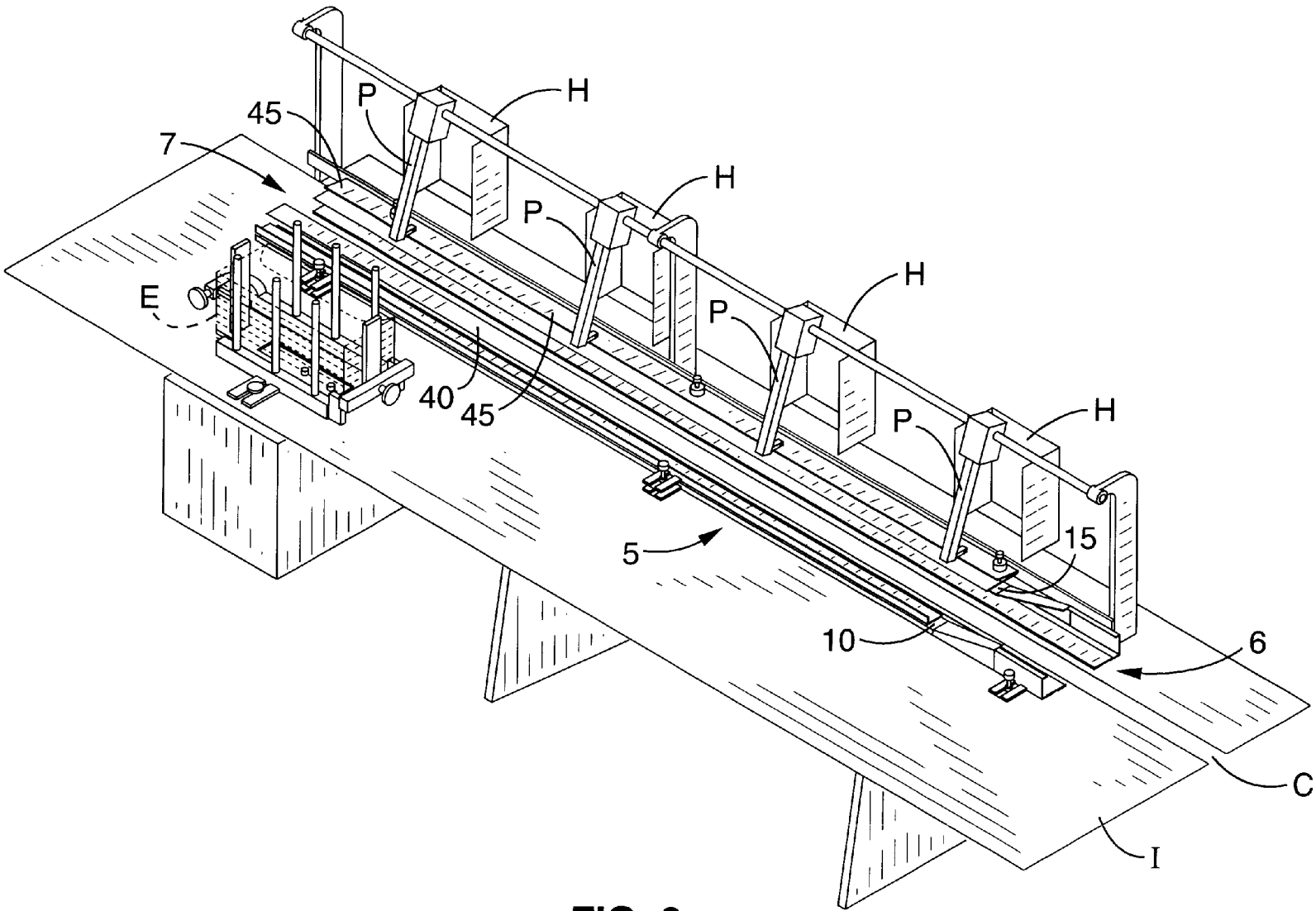
FIG. 2 is a perspective view of the subject invention attached to a typical inserter apparatus.
Figure 3:
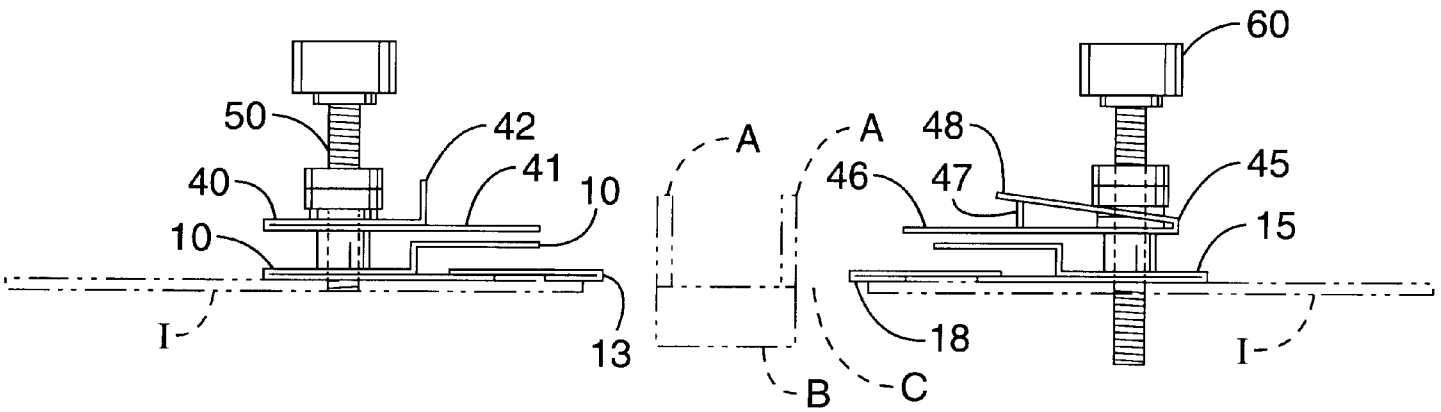
FIG. 3 is a cross-sectional view showing the upper and lower subject tracks with both sets of tracks positioned at first desired widths.
Figure 4:
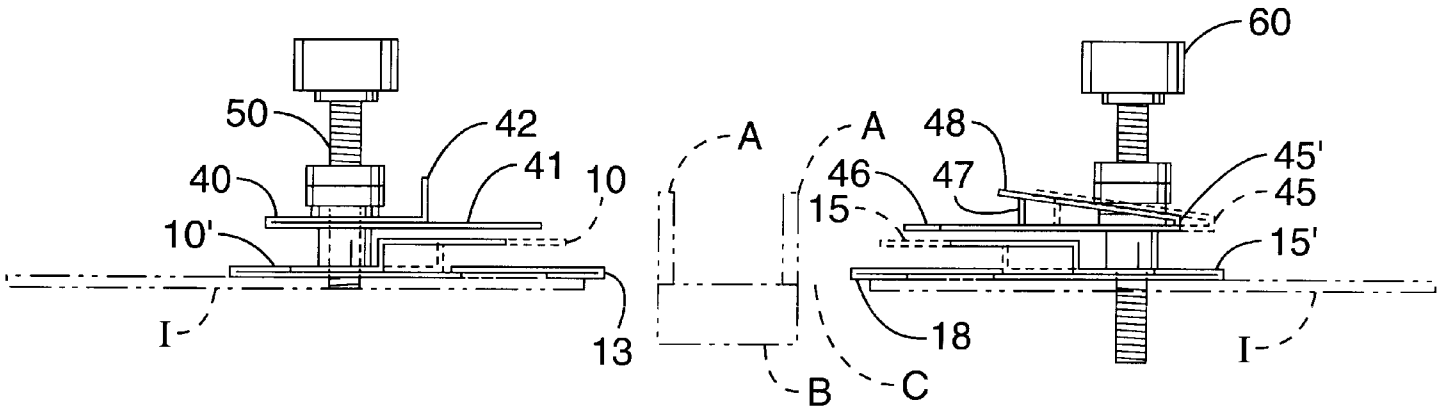
FIG. 4 is a cross-sectional view showing the upper and lower subject tracks with the upper track set at a first desired width and the lower track set at a second desired width.

As seen in FIGS. 3 and 4, to permit the lower and upper tracks to accept incoming forms or pages and inserts of various widths, both tracks are adjustable for increasing or decreasing the separation space between the two rails 10 and 15 or 40 and 45, respectively. For the lower track, both the front rail 10 and the rear rail 15 may be moved and positioned independently from one another. FIG. 3 illustrates the front rail 10 and rear rail 15 in a first position and FIG. 4 shows the front rail 10' and rear rail 15' in a second position.

For the upper track, the front rail 40 is usually in a fixed position (serving as a stable reference edge) and only the rear rail 45 may be moved to adjust the width of the upper track. FIG. 3 illustrates the front rail 40 in its fixed position and the rear rail 45 in a first position and FIG. 4 shows the rear rail 45' in a second position.

The width adjustment means is a releasable fastener that may comprise several suitable configurations that allow for easy release and locking of the rails, wherein, usually, the lower two rails 10 and 15 and rear upper rail 45 may be adjusted to a desired positions while the upper front rail 40 is held in a constant position. One embodiment of a width adjustment means comprises a plurality of threaded members 50 and 60, for the front and rear rails respectively. Each threaded member 50 and 60 has a knob 51 and 61, an upper locking nut 52 and 62, a washer 53 and 63, and an inter-track spacer 54 and 64. The threaded member 50, for the front rails, passes through an aperture 55 in the upper front rail 40 (thereby fixing the upper front rail's 40 position) and a slot 56 in the lower front rail 10 (thereby allowing the lower front rail 10 to have variable width positions) and threads into a receiving aperture in the inserter top surface. The threaded member 60, for the rear rails, passes through a slot 65 in the upper rear rail 45 and a slot 66 in the lower rear rail 15 (thereby allowing both the upper 45 and lower 15 rear rails to have variable width positions) and threads into a receiving aperture in the inserter top surface. Clearly, other equivalent width adjustment means are contemplated to be within the realm of this disclosure.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A document transporter apparatus for use on an envelope inserter having an upper support surface, comprising:

a) a plurality of vertically disposed tracks mounted to the support surface and b) independent width adjustment means associated with each track, wherein each track is adjustable to a desired width to accommodate a document transported within said track.

2. A document transporter apparatus according to claim 1, wherein said independent width adjustment means comprises a plurality of elongated securing members that extend through said plurality of vertically disposed tracks and releasably mated with the upper support surface.

3. A document transporter apparatus for use on an envelope inserter, comprising:

a) a first track, for moving a first type of document, mounted to the envelope inserter;

b) a second track, for moving a second type of document, mounted proximate said first track; and c) means for width adjustment on each of said first and said second tracks.

4. A document transporter apparatus according to claim 3, wherein said first and said second tracks are displaced vertically from one another.

5. A document transporter apparatus according to claim 3, wherein said first and said second tracks are displaced directly above and below one another.

6. A document transporter apparatus according to claim 3, wherein said first track comprises:

a) a front rail having lower and upper legs and b) a rear rail having lower and upper legs.

7. A document transporter apparatus according to claim 6, wherein said first track further comprises a gib strip secured immediately above each of said front and rear lower legs.

8. A document transporter apparatus according to claim 3, wherein said second track comprises:

a) a front rail and b) a rear rail.

9. A document transporter apparatus according to claim 8, wherein said width adjustment means comprises an elongated securing member extending through said first and second tracks and mated into receiving apertures in the envelope inserter, wherein for said second track said front rail is in a fixed-position rail and said rear rail is a variable-position rail.

10. A document transporter apparatus according to claim 3, wherein said width adjustment means comprises an elongated securing member extending through said first and second tracks and mated into receiving apertures in the envelope inserter.

11. A document transporter apparatus according to claim 3, wherein said width adjustment means comprises a knob-headed screw extending through said first and second tracks and mated within a threaded aperture in the envelope inserter.

12. A document transporter apparatus for use on an envelope inserter having an upper support surface, comprising:

a) a first track, for moving a first type of document, mounted to the upper support surface, wherein said first track comprises:

i) a variable-position front rail having lower and upper legs and ii) a variable-position rear rail having lower and upper legs;

b) a second track, for moving a second type of document, mounted above said first track, wherein said second track comprises:

i) a fixed-position front rail and ii) a variable-position rear rail;

c) a plurality of spacers positioned between said first and said second tracks; and d) means for width adjustment on each of said first and said second tracks, wherein a desired width between said front and rear rails for each of said first and said second tracks is selected independently.

13. A document transporter apparatus according to claim 12, wherein said first track further comprises a gib strip secured immediately above each of said front and rear lower legs.

14. A document transporter apparatus according to claim 12, wherein said width adjustment means comprises an elongated securing member extending through said first and second tracks and said spacers and mated into receiving apertures in the upper support surface.

15. A document transporter apparatus according to claim 12, wherein said width adjustment means comprises a knob-headed screw extending through said first and second tracks and said spacers and mated within a threaded aperture in the upper support surface.

* * * * *